US008784200B2

(12) United States Patent
Bartosik et al.

(10) Patent No.: US 8,784,200 B2
(45) Date of Patent: Jul. 22, 2014

(54) GAMING MACHINE AND METHOD HAVING BONUS FEATURE HIGHLIGHTING

(75) Inventors: Oliver Bartosik, Guntramsdorf (AT); Brigitte Bayler, Scharndorf (AT)

(73) Assignee: Novomatic AG, Gumpoldskirchen (AT)

( * ) Notice: Subject to any disclaimer, the term of this patent is extended or adjusted under 35 U.S.C. 154(b) by 840 days.

(21) Appl. No.: 13/011,868

(22) Filed: Jan. 22, 2011

(65) Prior Publication Data

US 2012/0190438 A1 Jul. 26, 2012

(51) Int. Cl.
*G07F 17/32* (2006.01)

(52) U.S. Cl.
USPC ..... 463/31; 463/16; 463/20; 463/25

(58) Field of Classification Search
USPC ..... 463/31, 16, 20, 25, 29
See application file for complete search history.

(56) References Cited

U.S. PATENT DOCUMENTS

2004/0198485 A1 10/2004 Loose et al.
2007/0060296 A1 3/2007 Yoshizawa
2008/0096655 A1 4/2008 Rasmussen et al.
2009/0131145 A1* 5/2009 Aoki et al. ..... 463/20
2009/0275387 A1 11/2009 Yoshizawa
2009/0286589 A1 11/2009 Rasmussen
2010/0062830 A1 3/2010 Hornik
2010/0304831 A1 12/2010 Suda et al.
2010/0317427 A1 12/2010 Ozaki et al.

* cited by examiner

*Primary Examiner* — Omkar Deodhar
(74) *Attorney, Agent, or Firm* — Kevin H. Fortin

(57) ABSTRACT

A gaming machine and method for displaying and highlighting a scatter symbol among a matrix of symbols. The display includes a first layer for displaying a background and a second layer overlying the first layer. In one embodiment the layers are virtual layers, in another embodiment the layers are discrete physical layers. The second layer displays the matrix of symbols including any scatter symbol included in the matrix of symbols. The second layer enables a gaming machine player to simultaneously view the background, or at least portions of the background. According to one aspect of the invention, the second layer is at least partially transmissive to permit simultaneous viewing of the background and the matrix of symbols. The background is changeable to highlight at least one of the symbols of the matrix of symbols. Preferably, the background highlights the scatter symbol by adding depth, color, light and imagery, such as a still, changing, or moving image.

17 Claims, 5 Drawing Sheets

GAMING MACHINE AND METHOD HAVING BONUS FEATURE HIGHLIGHTING

FIELD OF THE INVENTION

The invention pertains to gaming machines including slot machines, and particularly to slot machines having features that highlight a bonus symbol.

BACKGROUND OF THE INVENTION

In the gaming machine industry, there is a continuing need for gaming machine manufacturers to produce new types of games, or enhancements to existing games, which will attract frequent play by enhancing the entertainment value and excitement associated with the game.

US 2010/0062830 A1 to Hornik discloses on a transmissive display layer positioned in front of mechanical reels of a slot machine. The transmissive display layer depicts video images over the mechanical reels to indicate a bonus-award. The transmissive layer video images enhance ease recognition of a bonus-award for a player.

US 2010/0317427 A1 to Ozaki et al. discloses a slot machine with multiple-layer display capability. A back side display layer reveals a matrix of symbols and a front side display layer generates an overlapping pattern that relates to at least some of the symbols. The front side display is adapted to optimize the overlapping patterns so as to minimize blind spots.

US 2010/0304831 A1, to Suda et al. shows a slot machine having an array of symbols displayed for both primary and secondary (e.g. bonus) game play. The bonus game play is entered upon the occurrence of a selected event or outcome of the basic game. In particular, Suda describes using a subset of columns to indicate whether bonus game capability is achieved. In one embodiment, the columns in which scatter (i.e. bonus) symbols appear are selected for bonus game purposes.

US 2009/0275387 A1, to Yoshizawa, discloses a slot machine that displays a matrix of symbols as part of the primary game play and secondary game play occurs where the symbols are classified according to background color. The symbols having a common background color are grouped and re-positioned adjacent to each other on the display. In other words, symbols positioned once on a display are repositioned so as to gather the symbols with the same background color. Yoshizawa confirms that background effects can be an important part of gaming experience, particularly with secondary game play.

The gaming industry is competitive and ever-evolving. Although many games continue to entertain gaming enthusiasts, there is still an unmet need for better and more interesting games and features. There is also an unmet need for making gaming experience user-friendly to enable a player to readily understand the various gaming features and variations available.

SUMMARY OF THE INVENTION

The present invention includes a gaming machine having a display that reveals a matrix of symbols, including pre-determined "scatter" (i.e. bonus) symbols. A scatter symbol, thus, has a chance of appearing at least once in the matrix of symbols. Preferably the matrix of symbols is displayed in a format resembling slot-machine reels (i.e. virtual reels), or on physical reels. Virtual reels are an electronic representation of physical reels wherein each column of the matrix of symbols represents a reel The scatter symbol is broadly defined and includes any symbol, which is indicative of a bonus given in slot machine play. The scatter symbol may be a graphic image or a video streamed image displayed as a solid, opaque, transmissive or partially transmissive. In the present invention, the scatter symbol comprises a heart, which can be a fixed object, pulsating, moving or otherwise expressive object. It can be surrounded by animation, lights, or other method of highlighting the scatter symbol.

The gaming machine, in accordance with the present invention, includes a housing, which houses a computer and a display. The computer includes a control unit programmed for generating the matrix of symbols, and communicating the matrix of symbols to the display. The display presents the matrix of symbols in plain view to a gaming machine player.

In one embodiment of the invention the display is a single transmissive LCD panel, receptive to present multiple layers of images generated by the control unit. To accommodate the multiple layers of images, the control unit regulates the degree of opaqueness or transparency of each symbol and other images at various phases of game play. This capability is implemented, for example, when a background is presented to highlight a scatter symbol, and the non-scatter symbols in the matrix of symbols are adjusted by the controller to have more transparency when the background is displayed.

Although a display having single transmissive LCD panel is described herein, this single panel may comprise a composite including a touch screen, a protective cover, reflective elements, and a portion for displaying images. Accordingly, it can be appreciated that the term "single panel display" is broadly understood to include a composite display where the functional components are integrated.

The display mounts on the housing in communication with the control unit via a video cable, for example. The display is capable of displaying not only two dimensional objects, but also provides for the perception of depth, i.e. a third dimension. The display in such a case minimally includes a first layer for displaying a background and a second layer overlying the first layer. The second layer displays the matrix of symbols including any scatter symbol included in the matrix of symbols. The second layer is adjustably transmissive to enable a gaming machine player to simultaneously view the background, or at least portions of the background.

Where the second layer is adjusted to be at least partially transmissive, it permits simultaneous viewing of the background and the matrix of symbols. In one embodiment, the second layer becomes more transmissive when a scatter symbol is present. The background is changeable to highlight at least one of the symbols of the matrix of symbols. Preferably, the background highlights the scatter symbol by adding depth, color, light and imagery, such as a still, changing, or moving image.

In one embodiment of the invention, the matrix of symbols has rows and columns. The control unit causes the scatter symbol to be displayed in one of the columns on the second layer. The control unit changes the background of the column in which the scatter symbol is displayed to highlight the scatter symbol. Where the column is formatted to resemble a reel, or comprises a physical reel, the background highlights an area in proximity to the scatter symbol. Preferably, the control unit causes the background image to be displayed in a portion of the column where the scatter symbol is displayed.

More preferably, the control unit changes the background of an area extending on the background layer from the scatter symbol to, and including, the top row. Highlighting the column where the scatter symbol appears enables the scatter symbol to be an opaque object, which obscures a portion of the background, while enabling the other portions of the background to highlight the scatter symbol, at least in the column (or reel) portion situated above the scatter symbol. Where the scatter symbol appears in the top row, the background highlights the column generally below the scatter symbol in the same column where the scatter symbol is displayed.

According to one embodiment of the invention, the degree of transparency of symbols appearing in the same column where a scatter symbol is displayed are adjusted from opaque objects to partially transparent objects.

The format of the background may take any of a variety of forms. Preferably, the control unit generates an image resembling light beams extending on the background layer from the scatter symbol extending radially outwards from the scatter symbol, and particularly extending to the top row to highlight the scatter symbol. Where multiple scatter symbols appear on the matrix of symbols, an image of light beams extend from each of the scatter symbols.

The image of light beams extends at regular arc intervals to achieve symmetry, which has been determined to be aesthetically pleasing to gaming machine players. The image of light beams includes one end adjacent the scatter symbol, and a second end. The image of light beams varies in brightness intensity where the brightness intensity at the one end is greater than the intensity at the second end. The image of light beams may be linearly scaled in intensity from the one end adjacent the scatter symbol to the second end.

In a variation of the present invention, display includes a third layer and the control unit causes the third layer to generate an image to further highlight the scatter symbol, adding depth, color, light and imagery. The image on the third layer can be a still, changing, or a moving image. The image on the third layer and the background cooperate to highlight the scatter symbol.

During game play, reels are brought to a run state and each reel may be randomly stopped. In a case when the scatter symbol is displayed on a stopped reel then a center position of this scatter symbol is determined. For each reel where a scatter symbol is shown a background is generated having a pattern based on the center position of the respective scatter symbol on the reel. The background image and the symbol images of the respective reels are combined respectively merged to get a new display image that is displayed at the respective reel. The symbols may be fully opaque or partially transparent in foreground, for example.

DETAILED DESCRIPTION

Figure 1:
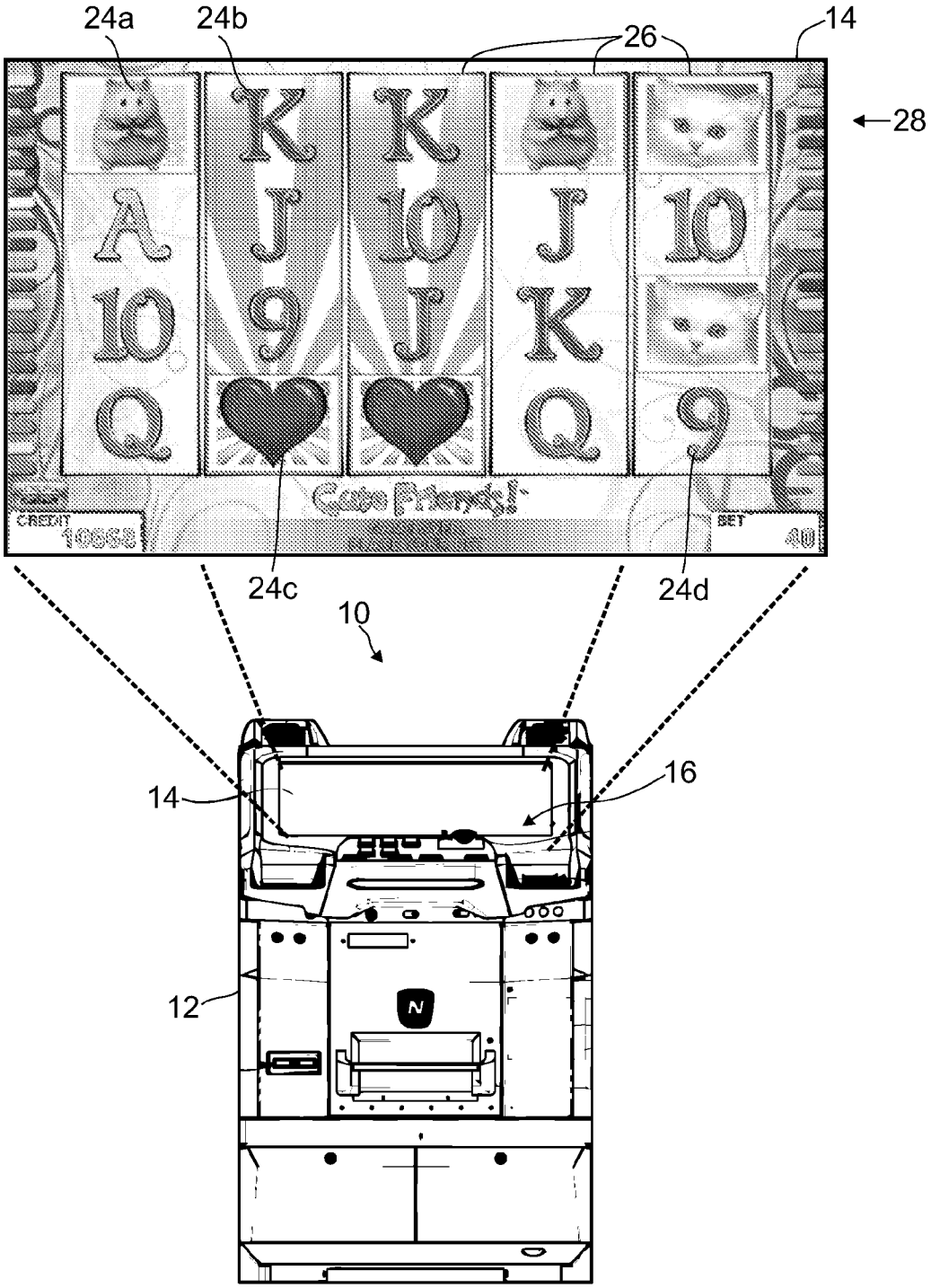
FIG. 1 is a housing having a display in accordance with the present invention.

FIG. 1 shows a gaming machine 10. The gaming machine 10 includes a housing 12 with a display 14 and a user interface 16. The gaming machine 10 is preferably a slot machine. Slot machine is broadly construed as any gaming machine that is capable of enabling a player to play for entertainment with a probability of a payout.

The interface 16 is supported by the housing 12. The interface 16 faces a user, who may be standing or sitting in proximity to the machine 10. The interface 16 enables user input to initiate and continue game play.

The display 14 is configured to display a matrix of symbols 26 that imitate mechanical slot machine reels according to one aspect of the invention. Accordingly, each column of the matrix of symbols imitates a single mechanical slot machine reel. The display 14 is angled with respect to the floor to face a user.

In another embodiment of the invention, the interface 16 includes mechanical slot machine reels. It can be appreciated that hybrid arrangements having both digital and mechanical components are contemplated herein.

The matrix 26 has four rows and five columns. The matrix also includes a top row 28. The matrix 26, however, may include any number of rows and columns in accordance with various game formats. The matrix 26 includes a plurality of symbols 24*a*, 24*b*, 24*c* and 24*d*.

In one aspect of the invention, the symbols 24 include playing card values, such as King, Jack, Queen, Joker and various numerical card values. The symbols 24 may also include any other symbols that create interest to a player including symbol 24*a*, which resembles a pet. Symbol 24*c* is a scatter symbol, which according to the particular game shown, comprises a heart shaped symbol. Although a poker-based theme is described herein, it can be appreciated that the present invention also encompasses non-poker based themes.

The symbols 24 can include digital images, or video-streamed images, or a combination of thereof. Such digital images, or video streamed images, or any combination thereof, may be displayed using virtual reels. Video streamed images enable the symbols 24 to yield an evolving appearance. In particular the size, character and transparency of the symbols may change during game play, particularly upon the appearance of a scatter symbol.

Figure 2:
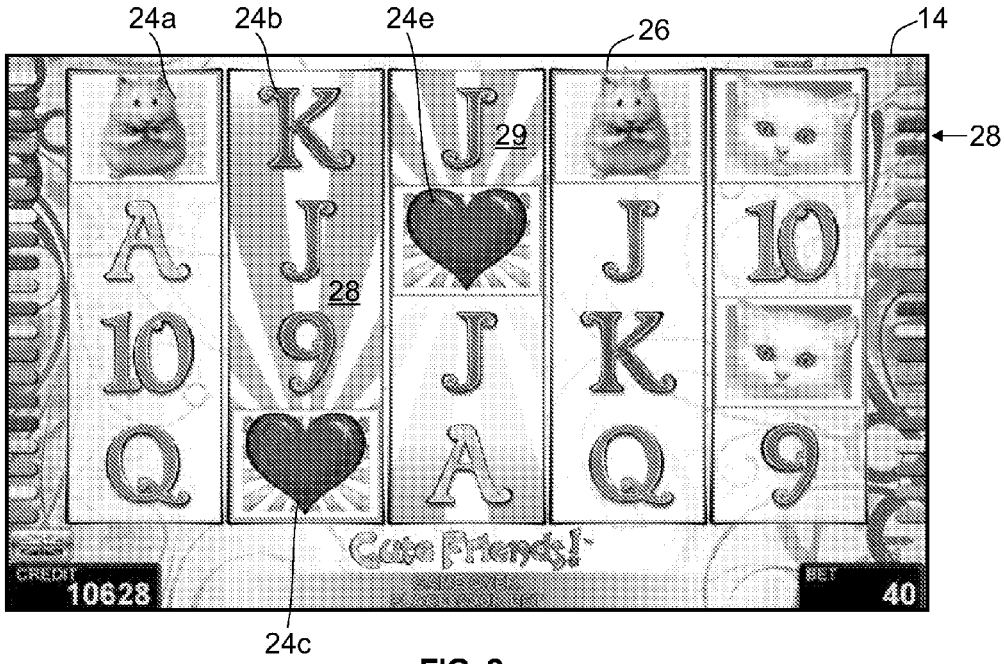
FIG. 2 is a front view of a display.

FIG. 2 shows the display 14. Each column of the matrix spins, resembling mechanical reels, and then the reels stop in a random position. The matrix 26 includes two scatter symbols 24*c* and 24*e*, aligned in the second column 30 and third column 32, respectively. A background 28 and a background 29 is displayed on the second column 30 and the third column 32, respectively.

Each background 28 and 29 extends from the scatter symbol 24*c* and 24*e*, respectively up to and including the top row 28. The background 28 and the background 29 include an image representing light beams extending radially from a center defined by each scatter symbols 24*c* and 24*e*, respectively. Each background 28 and 29 is configured to display the image of light beams so that they are depicted in regular arc intervals, where the images of light beams extend radially outwards from a center position defined in the corresponding scatter symbol and are being confined or trimmed by the width (dimension) of the respective reel. At least some of the images of light beams extend to, and are depicted on, the top row 28 on each reel where a scatter symbol appears.

The term "image resembling light beams" includes a representation of light rays that originate from a point and expand from that point. As such, the width of the light rays increases in a proportion directly dependent on the distance away from the point of origination. Each light ray is spaced from an adjacent light ray and the space between adjacent light rays increases in a proportion directly dependent on the distance away from the point of origination.

Figure 3:
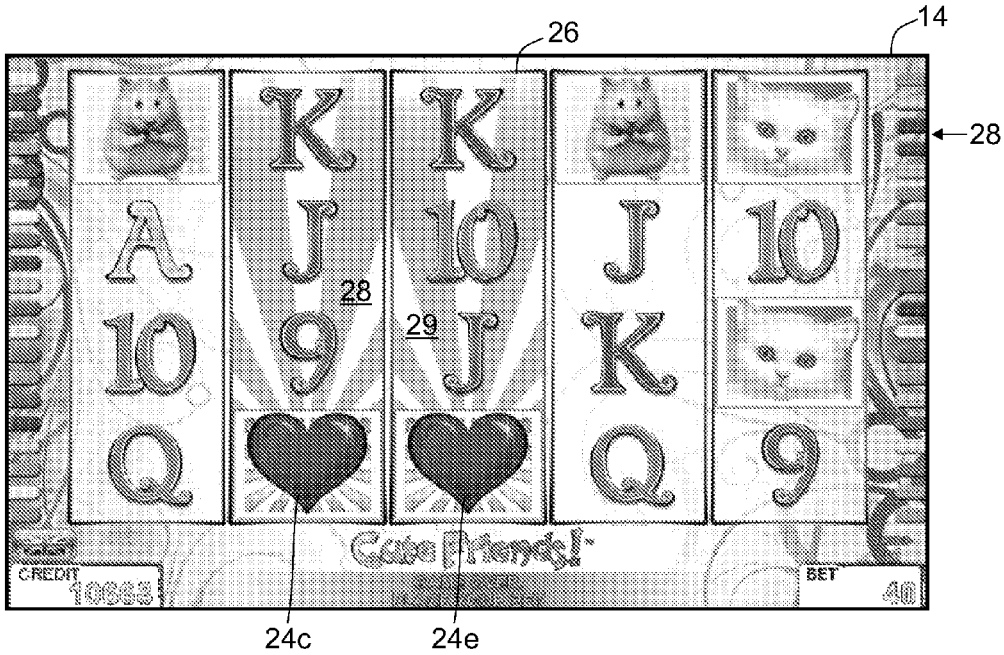
FIG. 3 is a front view of a display.

FIG. 3 shows the display 14 and another spin position of the matrix of symbols 26. The matrix of symbols 26 includes two scatter symbols 24*c* and 24*e*. The backgrounds 28 and 29 both extend from the scatter symbols 24*c* and 24*e*, respectively, to the top row 28.

Figure 4:
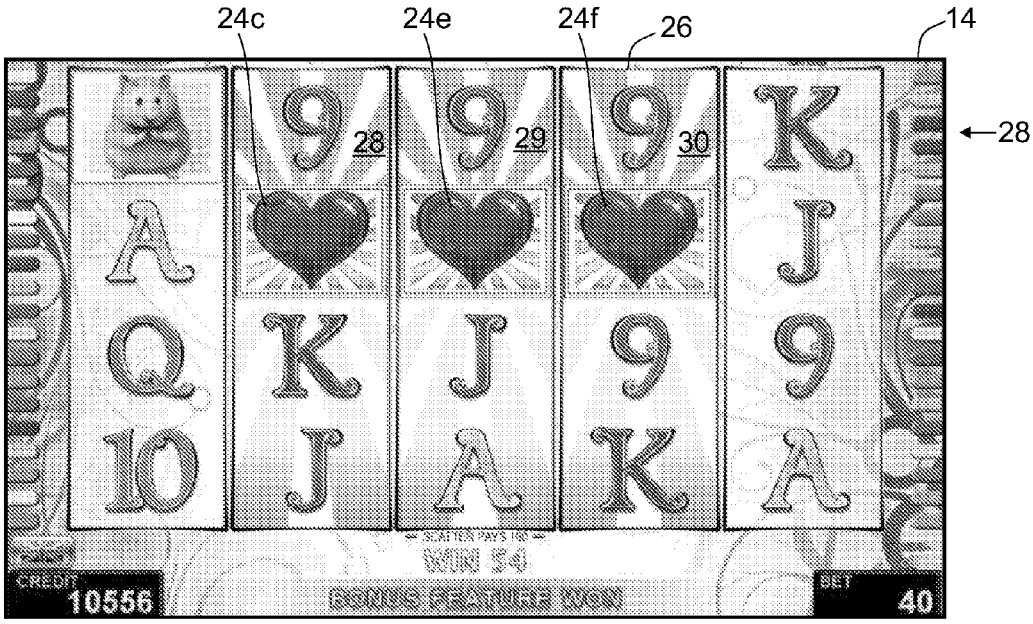
FIG. 4 is a front view of a display.

FIG. 4 shows the display 14 having a matrix of symbols 26 with three scatter symbols 24*c*, 24*e* and 24*f*. The background 28, 29 and 30 extend from the respective scatter symbols 24*c*, 24*e* and 24*f* to the top row 28 and to a bottom row. Game play is adapted so that any symbol displayed on the background 28, 29 and 30 is considered "wild", thus increasing payout for any payline implicated. In this figure, for example, since the symbol "9" is displayed on the background, and the numeral "9" is thus considered "wild", and the row 28 includes a "k" symbol representing a king in card play, then the payline comprising the top row 28 yields a payout associated with four kings, according to game play rules.

Figure 5:
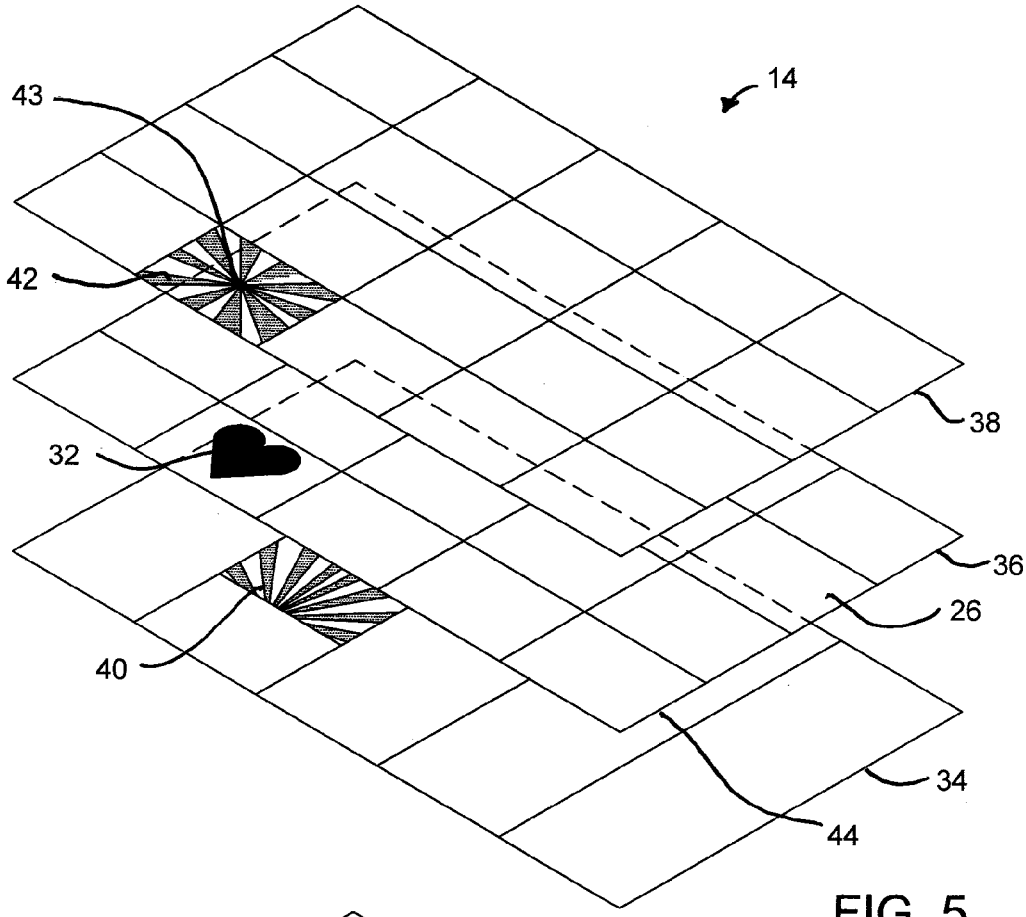
FIG. 5 is an exploded perspective view of a display having multiple layers.

FIG. 5 shows an exploded view of the display 14 according to another embodiment of the invention. The display 14 comprises a first layer 34, a second layer 36 and a third layer 38, which are discrete LCD panels At least two of the LCD panels are transmissive to enable the first layer 34 to display a background 40, visible to a game player. The display 14 is capable of displaying not only two dimensional objects, but also provides for the perception of depth, i.e. a third dimension.

The second layer 36 displays a matrix of symbols 26 including the scatter symbol 32 positioned on the bottom row 44 of the matrix of symbols 26. As shown the scatter symbol 32 is opaque. The layer 38 displays an image 42 to highlight the scatter symbol 32. The image 42 is an image of light rays extending radially from the center 43, which corresponds to the center of scatter symbol 32. The background 40 is also an image of light rays aligned with and extending from the center of the scatter symbol 32, or from a peripheral point of the scatter symbol, and extending on the reel where the scatter symbol 32 appears. The image 42 of the third layer 38 and the background 40 of the first layer 34 cooperate to highlight the scatter symbol 32.

The display 14 may include various projection devices and mirrors to project or communicate images onto either the first layer 34 or the third layer 38. The display 14 may include a second layer 36 as an integral part of the surface of a mechanical reel and the second layer may be flat or arcuate in shape. It can be appreciated that although the display is described using transmissive LCD technology, that the display 14 may also incorporate CRT, dot matrix, LED, OLED or electroluminescent technology.

The symbols and images displayed by the display 14 are superimposed according to the matrix of symbols 26 and the third layer 38 and the second layer 36 can be made transparent, translucent, or opaque in selected locations, and the degree of translucency can vary per instructions by the control unit.

Figure 6:
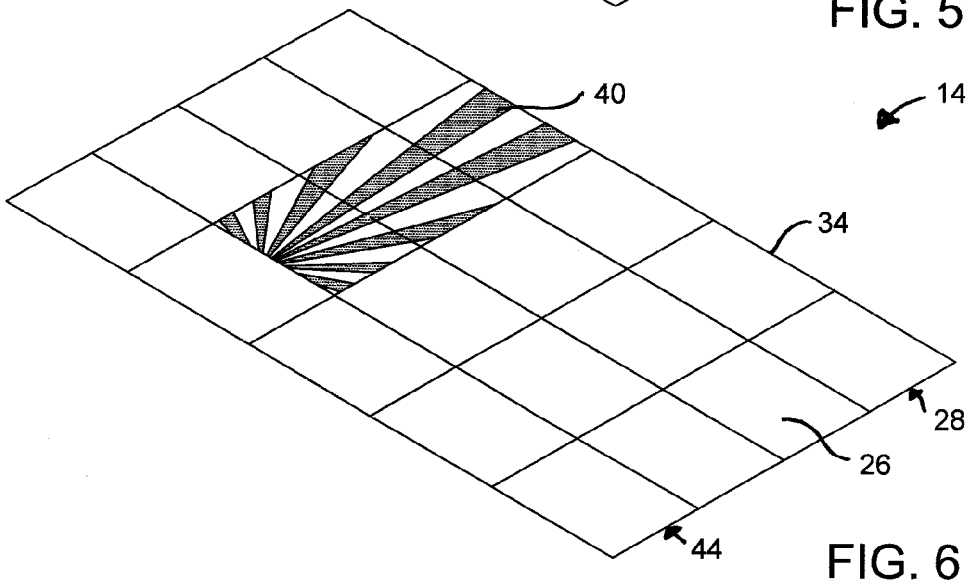
FIG. 6 is a perspective view of the background layer of the display of FIG. 5.

FIG. 6 shows the first layer 34 of the display 14. The background 40 extends in a single column to the top row 28 from the bottom row 44 where the scatter symbol is displayed (see also FIG. 5).

Figure 7:
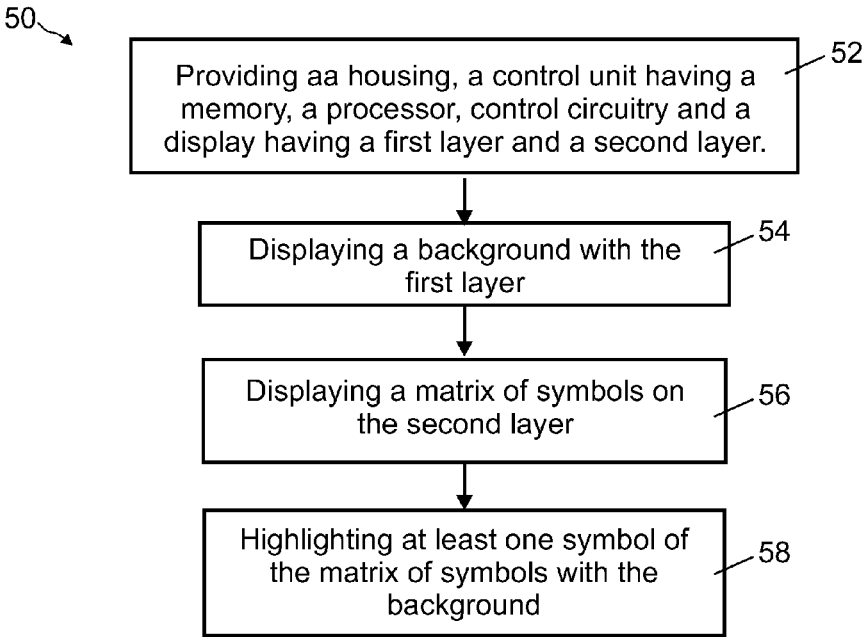
FIG. 7 is a flow chart in accordance with the present invention.

FIG. 7 shows a flowchart of a method 50 in accordance with the present invention. The method 50 includes the step 52 of providing a housing, a control unit having a memory, a processor, display control circuitry and a display having a first layer and a second layer. The method 10 includes the step 54 of displaying a background with the first layer, the step 56 of displaying a matrix of symbols 26 on the second layer and the step 58 of highlighting at least one symbol of the matrix of symbols with the background.

The first layer, the second layer and the third layer are virtual layers generated by the control unit and are displayed on a single panel display.

The controller generates a scatter symbol and communicates the scatter symbol to the display. The display presents the matrix of symbols and the scatter symbol as part of the matrix of symbols. The controller generates, communicates and causes the display to present a background image to highlight the scatter symbol. In one embodiment of the invention, the additional step of displaying the remaining matrix of symbols, which are normally opaque, as partially transmissive so that the background can be more readily seen and so that the background adds more significant highlight to the scatter symbol.

According to one embodiment of the method 10 an additional step of providing a third layer enables further highlighting of the scatter symbol.

Figure 8:
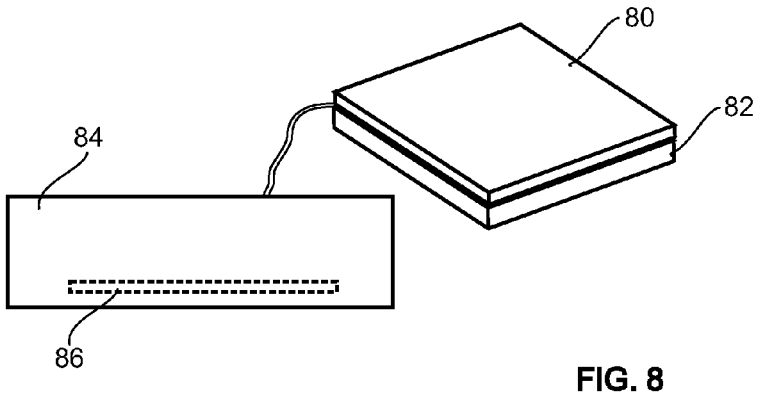
FIG. 8 shows a computer and a display interface in accordance with the present invention.

FIG. 8 shows the computer 84, which mounts in the housing 12 of the gaming machine 10 and the computer 84 connects with a display 80. The display 80 includes a transmissive LCD panel and may include an integrated touch-screen. The computer includes a main board 86 having a controller, memory connected to the main board for storing software, software stored in the memory for operating the display 80, software drivers, and a main processor.

Figure 9:
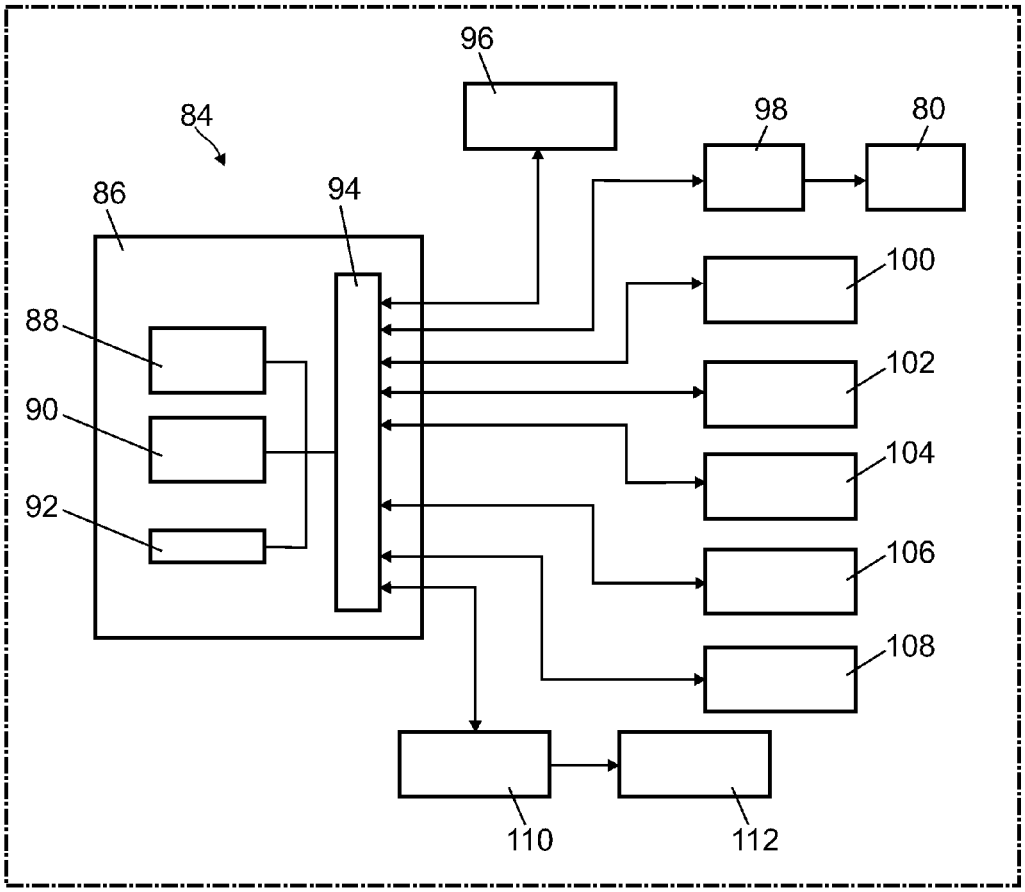
FIG. 9 is a system diagram in accordance with the present invention.

FIG. 9 shows a system diagram of the computer 84. The main board 86 includes program memory 88 being a computer readable medium, a main processor 90 and RAM 92 connected in operative communication. The computer 84 has an input output I/O controller 94. The I/O controller 94 communicates with a control panel 96, display interface driver circuitry 98, a display unit 100, a coin acceptor 102, a bill acceptor 104, a card reader 106, a ticket reader/printer 108, and a sound circuit 110. The sound circuit 110 is in operative communication with speakers 112.

The coin acceptor 102 and the bill acceptor 104 accept currency and communicate the amount accepted to the I/O controller 94. The card reader 106 reads credit cards, debit cards, gift cards or other card having electronic indicia of monetary value.

The ticket reader 108 prints tickets and receipts revealing the winnings of a player, or other financial outcome. The ticket reader 108 also receives tickets having indicia of monetary value, such as a bar code, which is read by the ticket reader 108.

The sound circuit 110 is configured to provide an acoustic-based interface for the user. Each movement or action by a user may result in a particular sound, or instruction being generated by the computer 84. The speakers 112 communicate the sounds to the user.

Unless the context requires otherwise, throughout the specification and claims which follow, the word "comprise" and variations thereof, such as, "comprises" and "comprising" are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and the include plural references unless the context clearly dictates otherwise. It should also be noted that the term or is generally employed in its sense including "and/or" unless the context clearly dictates otherwise.

The headings and the Abstract provided herein are for convenience only and do not interpret the scope or meaning of the embodiments.

It will be readily apparent to one of ordinary skill in the art that the various processes described herein may be implemented by, e.g., appropriately programmed general purpose computers, special purpose computers and computing devices. Typically a controller unit includes one or more microprocessors, one or more microcontrollers, one or more digital signal processors will receive instructions e.g., from a memory or like device, and execute those instructions, thereby performing one or more processes defined by those instructions.

A "processor" means one or more microprocessors, central processing units CPUs, computing devices, microcontrollers, digital signal processors, or like devices or any combination thereof.

Various embodiments can be configured to work in a network environment including the computer 84 that is in communication e.g., via a communications network with one or more devices. The computer 84 may communicate with the devices directly or indirectly, via any wired or wireless medium e.g. the Internet, LAN, WAN or Ethernet, Token Ring, a telephone line, a cable line, a radio channel, an optical communications line, commercial on-line service providers, bulletin board systems, a satellite communications link, a combination of any of the above. Any number and type of devices may be in communication with the computer.

In one embodiment, the present invention may be practiced on a network of one or more devices without a central authority. In such an embodiment, any functions described herein as performed by the server computer or data described as stored on the server computer may instead be performed by or stored on one or more such devices.

While the present invention is disclosed in terms of various specific embodiments, it can be appreciated that these embodiments are by way of example only. There are several variations contemplated by the present invention, and with the popularity of electronic gaming interfaces, the term "reel" should be broadly understood to include any set of moveable images, defining a matrix column, that are used to establish a payout. Accordingly, the scope of the invention is defined by the appended claims.

What is claimed is:

1. A gaming machine comprising:

a housing;

a control unit mounted in the housing for generating a matrix of symbols and a background;

a display mounted on the housing and in communication with the control unit, the display device including:

a first layer for displaying the background;

a second layer overlying the first layer for displaying the matrix of symbols having a top row, the second layer being at least partially transmissive to permit simultaneous viewing of the background and the matrix of symbols;

the background highlights at least one of the symbols of the matrix of symbols; and the matrix displays more than one scatter symbol and the control unit generates an image resembling light beams extending on the background layer from each scatter symbol on the background layer to the top row to highlight the scatter symbols.

2. A gaming machine as set forth in claim 1, wherein the matrix includes more than one scatter symbol and the control unit generates an image resembling light beams extending radially outward from each scatter symbol on the background layer.

3. A gaming machine as set forth in claim 1, wherein each image resembling light beams has a brightness intensity, a first end adjacent the scatter symbol and a second end, the brightness intensity adjacent the scatter symbol being greater than the intensity at the second end.

4. A gaming machine as set forth in claim 3, wherein the image resembling light beams extends at regular arc intervals from a center position of the scatter symbol.

5. A gaming machine as set forth in claim 1, wherein the display includes a third layer the control unit causes the third layer to generate an image to highlight the scatter symbol, whereby the image on the third layer and the background cooperate to highlight the scatter symbol.

6. A method of highlighting a scatter symbol on a gaming machine comprising:

providing a housing, a control unit having a memory, a processor and control circuitry mounted in the housing for generating a matrix of symbols, a display mounted on the housing in communication with the control unit, the display includes a first layer and a second layer;

displaying a background with the first layer; and displaying the matrix of symbols on the second layer, to enable simultaneous viewing of at least a portion of the background and the matrix of symbols;

generating a scatter symbol;

communicating the scatter symbol to the display;

presenting the scatter symbol as part of the matrix of symbols; and presenting a background image to highlight the scatter symbol;

the matrix has rows and columns, the method includes displaying the scatter symbol in one of the columns on the second layer and changing the background of the column where the scatter symbol is displayed;

displaying a background displays an image resembling a light beam in at least a portion of the column where the scatter symbol is displayed; and the matrix has a top row, displaying the background image includes displaying the background image on the background layer in an area extending from the scatter symbol.

7. A method as set forth in claim 6, wherein more than one scatter symbol is displayed and the background image is displayed for each scatter symbol.

8. A method as set forth in claim 6, wherein the background image resembles light beams extending radially outward from each scatter symbol on the background layer.

9. A method as set forth in claim 8, wherein the image resembling light beams has a brightness intensity, a first end adjacent the scatter symbol and a second end, the brightness intensity adjacent the scatter symbol being greater than the intensity at the second end.

10. A method as set forth in claim 9, wherein the background image extends at regular arc intervals.

11. A method as set forth in claim 6, further comprising providing a display with a third layer, the third layer being at least partially transmissive; and generating and displaying an image resembling light beams on the third layer to highlight the scatter symbol, whereby, the background and the image resembling light beams on the third layer cooperate to highlight the scatter symbol.

12. A gaming machine display comprising:

a first layer for displaying a background;

a second layer overlying the first layer for displaying the matrix of symbols, including at least one scatter symbol, the second layer being at least partially transmissive to permit simultaneous viewing of the background and the matrix of symbols; and a third layer overlying the second layer and being at least partially transmissive to enable the matrix of symbols of the second layer to be viewable through the third layer, the third layer including an image displayed over the scatter symbol to highlight the scatter symbol, whereby the background and the third layer image cooperate to highlight the scatter symbol.

13. A gaming machine display as set forth in claim 12, wherein the third layer includes a touch screen.

14. A gaming machine display as set forth in claim 12, wherein the first layer, second layer, and third layer are spaced apart to create a perception of depth.

15. A gaming machine comprising:

a housing;

a control unit mounted in the housing for generating a matrix of symbols and a background image;

a display mounted on the housing and in communication with the control unit, wherein the control unit is adapted for:

determining a position information of a scatter symbol shown within the matrix of symbols, and generating a background image based on the position information, and generating a display image including the background image and the symbols;

communicating the display image to the display;

the display includes a first layer for displaying a background;

a second layer overlying the first layer for displaying the matrix of symbols, including at least one scatter symbol, the second layer being at least partially transmissive to permit simultaneous viewing of the background and the matrix of symbols;

a third layer overlying the second layer and being at least partially transmissive to enable the matrix of symbols of the second layer to be viewable through the third layer, the third layer including an image displayed over the scatter symbol to highlight the scatter symbol, and whereby the background and the third layer image cooperate to highlight the scatter symbol.

16. A gaming machine as set forth in claim 15, wherein the scatter symbol has a center and background image is an image of light rays extending radially outward from the center of the scatter symbol.

17. A gaming machine as set forth in claim 16, wherein the matrix of symbols includes rows and columns, each column resembles a slot machine reel, the scatter symbol appears on a particular column and the image of light rays extends only on the column where the scatter symbol appears.

* * * * *